United States Patent [19]

Freeman et al.

[11] Patent Number: 4,486,727

[45] Date of Patent: Dec. 4, 1984

[54] ELECTROMAGNETIC RELAY

[75] Inventors: Albert L. Freeman; Brian H. Taylor, both of Harlow; Roy E. R. Smith, Bishop's Stortford, all of England

[73] Assignee: International Standard Electric Corporation, New York, N.Y.

[21] Appl. No.: 421,674

[22] Filed: Sep. 21, 1982

[30] Foreign Application Priority Data

Sep. 22, 1981 [GB] United Kingdom ..... 8128565

[51] Int. Cl.[3] ..... H01H 67/00

[52] U.S. Cl. ..... 335/106; 335/128

[58] Field of Search ..... 335/106, 107, 203, 128

[56] References Cited

U.S. PATENT DOCUMENTS

| | | | |
|---|---|---|---|
| 3,394,326 | 7/1968 | Woodhead | 335/106 |
| 3,553,729 | 1/1971 | Mori et al. | 335/106 |
| 4,227,162 | 10/1980 | Fujita et al. | 335/106 |
| 4,260,971 | 4/1981 | Baumruck | 335/106 |
| 4,364,018 | 12/1982 | Dammert et al. | 335/106 |

FOREIGN PATENT DOCUMENTS

| | | | |
|---|---|---|---|
| 1387112 | 3/1973 | United Kingdom | 335/106 |

*Primary Examiner*—E. A. Goldberg
*Assistant Examiner*—George Andrews
*Attorney, Agent, or Firm*—T. E. Kristofferson; T. L. Peterson

[57] ABSTRACT

A miniature DIL relay comprising a motor unit and a casing (1) housing the motor unit (2) and including opposed sidewalls (**14, 14*a*) of insulating plastics material, each sidewall having embedded therein a conductor frame providing external connection terminals (15, 16, 17) of the relay and supporting the fixed and moving relay contacts (8, 11, 6, 7) in the casing, the motor unit having a bobbin with a pair of external connection terminals (18, 21**) mounted thereon which project through the casing and which are connected to the motor unit winding.

2 Claims, 3 Drawing Figures

ELECTROMAGNETIC RELAY

BACKGROUND OF THE INVENTION

This invention relates to miniature relays.

A miniature Dual-in-line (DIL) relay is disclosed in U.K. Patent Specification No. 1,387,112 in which the motor unit is held between two opposing casing halves which link together to lock the motor unit in position. The casing halves have embedded in respective sidewalls thereof a conductor frame which projects below the casing to provide external DIL connection tags and projects from the other edge of each sidewall to support the fixed and moving contacts of the relay and to provide connection terminals for the ends of the motor unit winding.

This relay does not lend itself ideally to automatic assembly, partly because the winding of the motor unit is terminated manually to the connection terminals of the conductor frame, which is a delicate operation and can result in a poor yield caused by faulty connections. Furthermore in a development of the relay shown in this patent, the yoke of the motor unit has sideways projecting lugs which fit into apertures in the sidewalls carrying the conductor frames, which apertures locate the motor unit. This arrangement however requires the motor unit and sidewalls to be nested and assembled together, and it is a difficult operation to achieve, at least in the short term, the necessary degree of mechanization for acceptable automatic assembly.

SUMMARY OF THE INVENTION

According to one aspect of the present invention there is provided a miniature relay comprising a motor unit and a casing housing the motor unit and including opposed sidewalls of insulating plastics material, each sidewall having embedded therein a conductor frame providing external connection terminals of the relay and supporting the fixed and moving relay contacts in the casing, characterized in that the motor unit (2) has a bobbin with a pair of external connection terminals (18, 21) mounted thereon which project through the casing (1) and which are connected to the motor unit winding (20).

According to a further aspect of the present invention there is provided a method of making a miniature relay comprising providing a casing with holes in the underside corresponding to the intended positions of external connection terminal, a pair of sidewalls of insulating material, each sidewall having embedded therein a conductor frame providing external connection terminals of the relay and supporting the fixed and moving relay contacts, and a motor unit to fit between the sidewalls, characterized in that the motor unit (2) has a pair of external connection terminals (18, 21) mounted on a bobbin of the motor unit and connected to a winding (20) on the bobbin, in that the motor unit (2) is inserted in the casing (1) so that the pair of connection terminals (18, 21) locate in a pair of the said holes, to thereby locate the motor unit (2) in the casing (1), and the sidewalls (14, 14*a*) are inserted in respective gaps between the motor unit (2) and outer walls of the casing (1) so that the external connection terminals (15, 16, 17) of the conductor frame locate in the said holes in the underside of the casing (1).

According to yet another aspect of the invention there is provided a method of making a relay comprising providing an electromagnetic motor unit having an armature and providing a changeover contact set including two fixed contacts and a movable contact carried by an insulating sidewall adjacent the motor unit with connection terminals projecting from the sidewall, characterized in that a first temporary adjustment of the relative position of the motor unit (2) and sidewall (14) is made so that with the motor unit energized the armature (3) causes the movable contact spring (6) to just make with one of the fixed contacts (11), and then a second permanent adjustment of said relative position is made to obtain a predetermined over-travel of the movable contact spring (6).

BRIEF DESCRIPTION OF THE DRAWINGS

In order that the invention can be more clearly understood reference will now be made to the accompanying drawings in which.

DETAILED DESCRIPTION OF THE DRAWINGS

Figure 1:
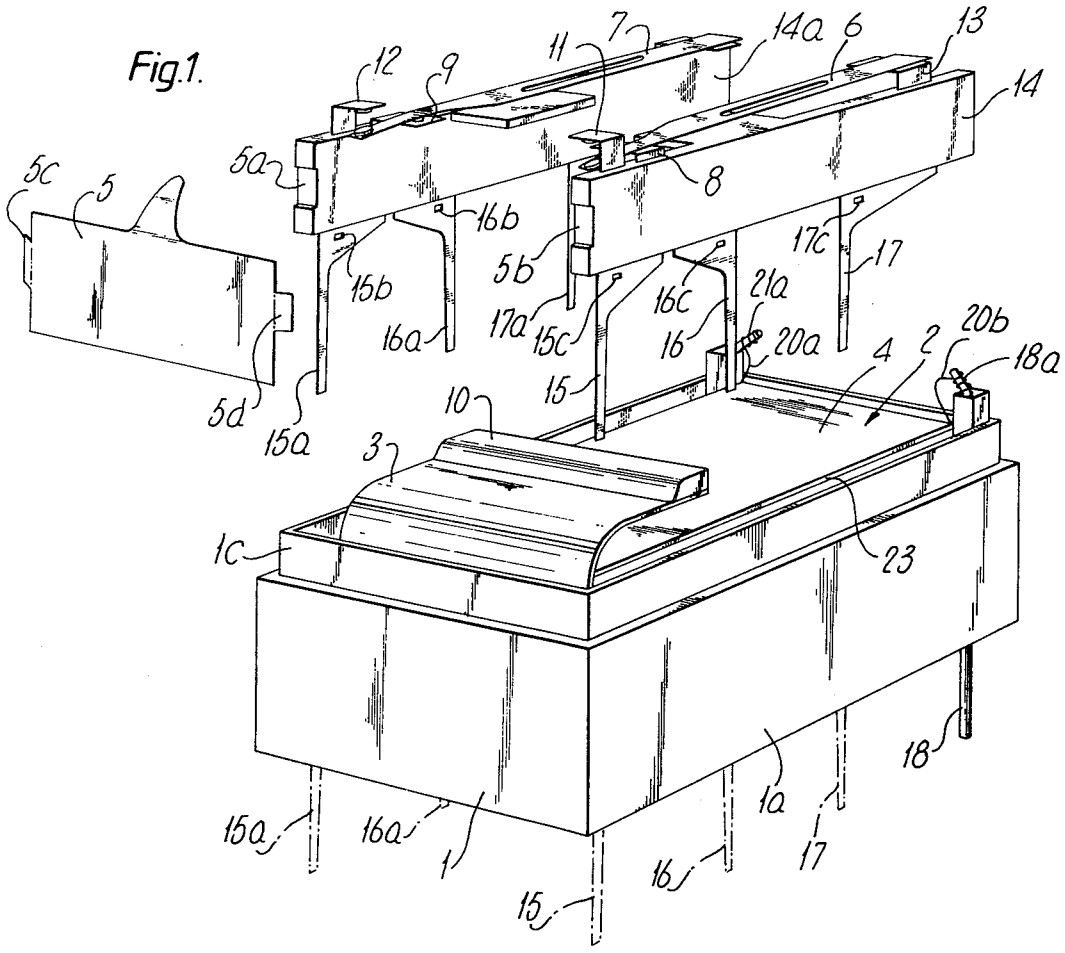
FIG. 1 is an exploded view of a miniature DIL relay according to an embodiment of the invention.

Referring to FIG. 1 of the drawing there is shown an "exploded" view of the essential parts of a miniature Dual-in-line (DIL) relay.

The relay comprises a plastics moulded casing 1 which has in its underneath face two rows of four holes each (not shown) to accommodate external connection terminals of the relay. Into the casing 1 has been inserted a motor unit 2, shown more clearly in FIG. 2 of the drawings and an armature 3 on the end of yoke 4 of the motor unit. A return spring 5 biases the armature 3 to a position in which the movable contact springs 6 and 7 will be in their rest position on the lower fixed contacts 8 and 9 and the armature 3 has a plastics comb 10 for picking up the movable contact springs 6 and 7 during operation. Fixed contacts 11, 12 will make contact with the movable contact springs 6, 7 when the relay is operated.

As shown in FIG. 1 the fixed contacts 8, 11 and the mount 13 for the movable contact 6 are all formed from a conductive frame which has been stamped from a continuous strip of conductive frame material and embedded in a plastic sidewall 14. Fixed contacts 8, 11 and the mount 13 are each connected to respective external connection terminals 15, 16 and 17 which, when the sidewall 14 is inserted in the gap between the outer wall 1*a* of casing 1 and the adjacent side of the motor unit 2, will project through the aforementioned holes (not shown) in the underside of the casing 1. These three external connection terminals 15, 16 and 17, together with a further external connection terminal 18 form one row of the connection terminals of the Dual-in-line relay.

Figure 2:
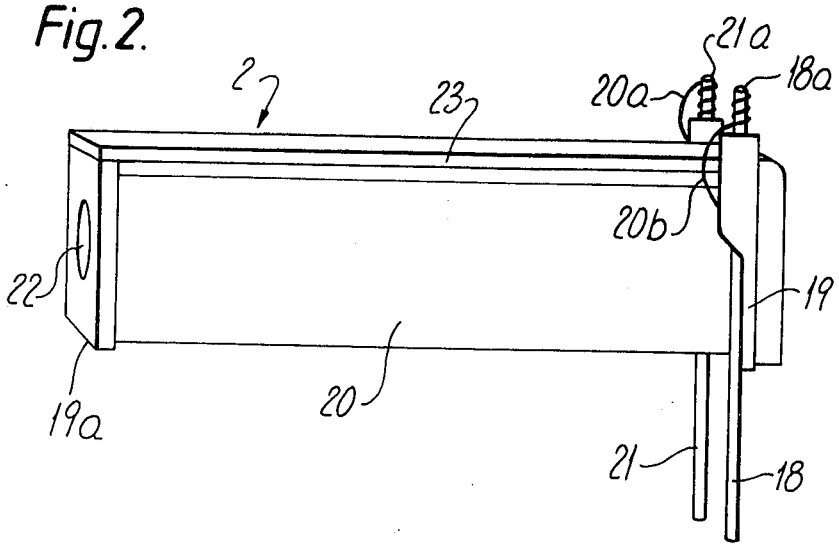
FIG. 2 shows the motor unit of FIG. 1.

The connection terminal 18 is not embedded in the plastics sidewall 14 but is, instead, mounted on one end cheek 19 of the motor unit bobbin, as shown in FIG. 2. The upper end 18*a* of this connection terminal forms a wiring tag for one end of the winding 20 of the motor unit 2. Similarly a further connection terminal 21 on the other side of the motor unit is mounted on cheek 19 and is connected at 21*a* to the other end of the winding 20 of the motor unit 2. Both terminals 18 and 21 as mentioned are mounted on the end cheek 19 of the bobbin which in this instance is moulded from plastics material. The terminals can have a tangled stake which bites in a groove in the cheek 19, or can alternatively be embedded therein during the cheek moulding process. Either way they are firmly irremovably held to the motor unit. This enables the winding, which for 48 volt working as is current for Post Office use in the U.K., to be automatically wound and terminated using a very fine wire, of the order of 0.03 mm to 0.09 mm. Once the winding has been wound and terminated (or tagged) the terminations are soldered and the bobbin is then mounted on a magnetic iron core 22 and a yoke 23 is fitted on the right hand end of the core 22, as viewed in FIG. 2, and staked thereto (not shown).

Incidentally the tagged ends 21*a*, 18*a* are, as shown in FIG. 1, bent inwardly to detention the wire ends 20*a* and 20*b*.

When the motor unit has been tested it is inserted into the case 1 as shown in FIG. 1 so that the terminals 18, 21 project through the respective holes (not shown) in the underside face of the casing 1. Thus the terminals 18, 21 together with the end cheek 19*a* of the motor unit act to locate the motor unit accurately in the casing, leaving a gap on either side exactly the right size to accommodate sidewalls 14 and 14*a*.

Next in the assembly procedure, the armature 3 is offered to the end of the yoke 23 and the motor unit is energized by its external connection terminals 18, 21, thus to hold the armature in its operated position. It is anticipated that this can be done on a continuous production line using the connection terminals 18 and 21 to pick up the motor unit in the casing and carry it forward as well as energizing the winding.

Then the sidewalls 14, 14*a* with their embedded terminals and fixed and moving contacts are offered up to the casing with the motor unit in it, and slid in between the motor unit and the adjacent outer walls, such as 1*a* shown in FIG. 1, until the external connection terminals 15, 16 and 17 and 15*a*, 16*a* and 17*a* locate in the respective holes in the underside face of the casing 1. The outer walls 1*a* include an upper rim portion 1*c* which surrounds the upper portions of the sidewalls 14, 14*a* and of the motor unit 2 when the sidewalls are installed in the casing 1.

On the near ends of the sidewalls 14 and 14*a* can be seen slots 5*a* and 5*b* which receive respective lugs 5*c* and 5*d* on the return spring 5. The return spring is mounted on the ends of the sidewalls 14 and 14*a* and the sidewalls are then advanced further into the casing so that the spring becomes trapped between the end wall of the casing 1 and the slots 5*a*, 5*b* in the sidewalls 14*a*, 14, respectively.

Also sprags such as 15*b*, 15*c*, 16*b*, 16*c* and 17*c* formed in the respective connection terminals positively lock the connection terminals in the plastics casing 1 and provide a frictional force against which the sidewalls are advanced. An ultrasonic force can be superimposed on the direct insertion force to help overcome the friction and partially fluidize the plastic to ease insertion. This direct insertion force would be about 1 kg without the ultrasonic energy which may be applied by a piezoelectric force generator placed in series in the insertion direction. It could apply 0.5 watt of ultrasonic energy so the direct insertion force could be considerably less than 1 kg. The frequency could be 20 to 200 KHz.

When sidewalls are advanced a certain distance the comb 10 of the still-energized armature 3 will begin to pick up the movable lever contacts 6 and 7 until they are lifted from their lower fixed contacts 8 and 9 and eventually make contact with their respective upper fixed contacts 11 and 12.

The connection terminals 15 and 17 and 15*a* and 17*a* can be used with a sensing circuit to detect when contact is made with the respective upper contacts 11 and 12 and this can be used as a signal to indicate the exact position of the sidewalls 14 and 14*a* in the casing. In order to obtain the correct amount of over-travel of armature during normal operation of the relay, the sidewalls 14 and 14*a* are then advanced, following receipt of the signal that the upper contacts 11 and 12 have been met, by a certain predetermined further amount which will establish the correct amount of over-travel for the armature 3. The sidewalls 14 and 14*a* are then glued into position in the casing to fix the adjusted positions and to seal the terminals in the holes in the undersides of the casing 1. The application of ultrasonic energy will enable greater accuracy than hitherto.

Figure 3:
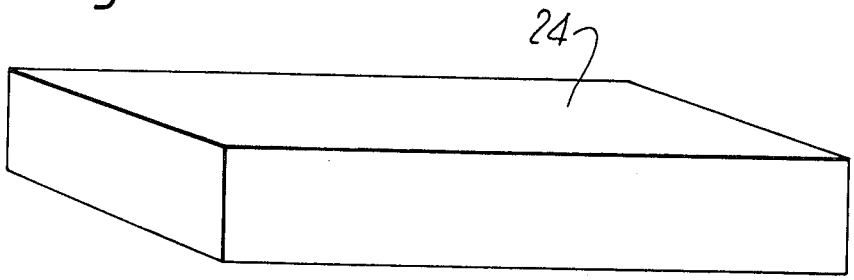
FIG. 3 shows a dust cover.

Finally a dust cap 24, shown in FIG. 3 of the drawings, is clipped over the ledge 1*c* on the upper side of the casing 1 to complete the relay.

It can be seen that by manufacturing the motor unit with its own connection tags, in association with the separate sidewalls, a sequential assembly technique can be adopted which lends itself well to fully automated production. Thus the casing first receives the motor unit; the armature 3 is then placed on the motor unit; the motor unit is energized; the sidewalls 14 and 14*a* are inserted in the gaps between the sides of the casing and the sides of the motor unit by an initial amount; the return spring 5 is inserted in the slots 5*a*, 5*b*; the sidewalls are further advanced in the casing until the spring becomes trapped and contact is made between the movable springs 6 and 7 and their respective upper fixed contacts 11 and 12; the signal is used to indicate that this position has been reached and the sidewalls are then advanced a further predetermined distance to set the desired amount of over-travel; the sidewalls are fixed into position in the casing with adhesive and sealed; and the dust cap is then secured to the top of the casing.

The manufacture of the sidewalls 14 and 14*a* with the embedded conductor is a known technique but in the past all four conductors, i.e. also including the conductor necessary for the winding of the motor unit, have also been embedded in the plastics sidewall. In the relay described however the connection terminal for the motor unit winding is transferred to the motor unit bobbin which is a significant departure in this type of relay. It has the great advantage of enabling automatic winding and termination of the bobbin because the connection terminals are already on the bobbin and these terminals are used to locate the motor unit in the casing prior to assembly of the sidewalls 14 and 14*a*.

1. A dual-in-line relay comprising:

a generally rectangular casing having a pair of elongated parallel sides, two opposite ends, and a bottom;

a motor unit mounted in said casing having elongated sides spaced from said sides of said casing forming two channels on opposite sides of said motor unit;

said motor unit including a core, a bobbin having a winding thereon surrounding said core, a yoke, and terminals on opposite sides of said motor unit adjacent to one end thereof each connected to an end of said winding;

a pair of sidewall elements, each said element comprising an insulator having terminals mounted thereon, said terminals being associated with fixed and movable relay contacts supported by said insulator;

each of said sidewall elements being mounted lengthwise in a corresponding one of said channels, with said terminals thereof aligned with one of said motor unit terminals so that there is provided two rows of terminals; and said terminals of said motor unit and of said sidewall elements extending through said bottom of said casing.

2. A dual-in-line relay as claimed in claim 1 wherein:

said bobbin has laterally outwardly extending projections thereon adjacent to said one end of said motor unit, said motor unit terminals being mounted in said projections, said projections bearing against said sides of said casing.

* * * * *